US005958482A

United States Patent [19]

Monforton

[11] Patent Number: 5,958,482

[45] Date of Patent: Sep. 28, 1999

[54] EASILY EXPANDABLE NONTRAPPING FLEXIBLE PAPER MICROWAVABLE POPCORN PACKAGE

[75] Inventor: Randal J. Monforton, Eden Prairie, Minn.

[73] Assignee: General Mills, Inc., Minneapolis, Minn.

[21] Appl. No.: 08/954,244

[22] Filed: Oct. 20, 1997

[51] Int. Cl.[6] ..... B65B 25/22; B65B 29/08; B65D 81/34

[52] U.S. Cl. ..... 426/107; 426/111; 426/112; 426/113; 426/115; 426/118; 426/123; 426/234; 426/243; 426/395; 383/210; 383/211; 383/903; 383/100; 383/66; 219/727; 219/730

[58] Field of Search ..... 426/107, 111, 426/112, 113, 115, 118, 122, 123, 234, 243, 395; 383/210, 211, 903, 100, 66; 219/729, 727, 730

[56] References Cited

U.S. PATENT DOCUMENTS

| | | | |
|---|---|---|---|
| 2,673,805 | 3/1954 | Colman | 426/111 |
| 3,052,554 | 9/1962 | Colman | 383/100 X |
| 3,389,783 | 6/1968 | Bjorkengren | 206/46 |
| 3,835,280 | 9/1974 | Gades et al. | 219/729 |
| 4,141,487 | 2/1979 | Faust et al. | 426/111 X |
| 4,358,466 | 11/1982 | Stevenson | 426/106 |
| 4,596,713 | 6/1986 | Burdette | 426/107 |
| 4,640,838 | 2/1987 | Isakson et al. | 426/107 |
| 4,734,288 | 3/1988 | Engstrom et al. | 426/107 |
| 4,810,844 | 3/1989 | Anderson | 426/107 X |
| 4,851,246 | 7/1989 | Maxwell et al. | 426/107 |
| 4,874,620 | 10/1989 | Mendenhall et al. | 426/107 X |
| 4,892,744 | 1/1990 | Ylvisaker | 426/111 |
| 4,950,859 | 8/1990 | Anderson | 426/111 X |
| 4,963,374 | 10/1990 | Brandel et al. | 426/107 |
| 4,973,810 | 11/1990 | Brauner | 426/107 X |
| 5,171,950 | 12/1992 | Brauner et al. | 426/107 X |
| 5,189,272 | 2/1993 | McDonald et al. | 426/107 X |
| 5,294,764 | 3/1994 | Mass | 426/107 X |
| 5,622,432 | 4/1997 | Zicker | 383/210 |

FOREIGN PATENT DOCUMENTS

WO9109656 7/1991 WIPO .

*Primary Examiner*—Milton Cano
*Attorney, Agent, or Firm*—Douglas J. Taylor; John A. O'Toole; Alan D. Kamrath

[57] ABSTRACT

A flexible paper popcorn package in the form of an easily expandable, nontrapping bag (18) is disclosed including a bottom wall (20) and a top wall (22) interconnected together adjacent their circular outer peripheries (20*a*, 22*a*) by first and second interconnection portions. The top wall (22) is formed by first and second wall portions (22*b*, 22*c*) interconnected together by a peelable closure seal (28).

22 Claims, 4 Drawing Sheets

EASILY EXPANDABLE NONTRAPPING FLEXIBLE PAPER MICROWAVABLE POPCORN PACKAGE

BACKGROUND

The present invention relates generally to packages for use in microwave ovens, and pertains more particularly to an easily expandable, nontrapping, flexible, microwave package formed of non-extendable material for the popping or puffing of grains and especially popcorn kernels.

To conserve space during shipping and storage, microwave popcorn packages are often folded flat. During popping by use of microwave energy, the popcorn package expands, with the expansion due to the internal pressure of the steam produced by the popping of the popcorn kernels, the pressure of the popped kernels themselves, as well as other factors. An important feature for maximizing the volume of the popped kernels is the ability of the microwave popcorn package to easily expand. Another important factor for maximizing the volume of the popped kernels is that the number of kernels which are actually popped be maximized by insuring that the unpopped kernels are located together on the susceptor with sufficient dwell time to receive sufficient heat energy to result in popping. The shape of the bag plays an important role in the ability of the bag to expand as well as the ability of unpopped kernels to come in contact with each other and the susceptor before and during popping.

One form of conventional popcorn packages is a bag having a rectangular top, a rectangular bottom and pleated sides and with at least one end being sealed together by attaching the top and bottom together such as but not limited to by folding the end of the bag over onto itself. It is a common problem for unpopped kernels to be propelled in the popping process into folds and crevices in the bag and especially those created by the pleats in the sides adjacent to the end(s) of the bag. Such kernels may tend to be captured in such folds and crevices so that they are unable to travel towards the susceptor and are less likely to be popped during microwave cooking.

Additionally, when first placed in the microwave oven, the pleats of the sides of conventional popcorn packages extend at least partially over the charge of popcorn kernels to be popped. Thus, the initial microwave energy has to penetrate several layers of material which forms the bag. As the material is not completely transparent to microwave energy, part of the microwave energy is absorbed by the material which then is generally not available to the charge of popcorn kernels.

Further, conventional rectangular popcorn bags tend to get hung up in the corners of the microwave ovens. This is undesirable for microwave ovens including turntables as the bag will no longer rotate inside of the microwave cavity but is locked in position by the corner. However, even for microwave ovens which are not equipped with turntables, the expansion of the bag and/or the vibration of the bag caused by the popping of the popcorn does not result in moving the bag to the center of the microwave cavity when the bag gets hung up in a corner of the microwave cavity. This is undesirable as cooler spots typically exist in the corners of the microwave cavity and as lack of movement of the bag subjects certain points in the bag to see specific hot spots or electronic nulls.

Thus, a need continues to exist for an improved flexible paper popcorn package which is easily expandable by the dynamics involved in popping the kernels, which is less likely to capture unpopped kernels during the expansion of the package while subjected to microwave energy, and which provides the most consistent and uniform distribution of microwave energy in maximizing the number and volume of popped popcorn.

Surprisingly, the above need and other objectives can be satisfied by providing, in the preferred form, an expandable microwave package in the form of a bag formed by top and bottom walls of flexible, non-extendable material interconnected together adjacent to their round-like shaped outer peripheries so that the top and bottom walls expand into an opposing double domed shape when the popcorn kernels are popped in the microwave oven. In the most preferred form, the top wall includes a peelable closure seal which vents during microwave cooking and which can be physically separated after microwave cooking for ease of access to the popped popcorn and so that the bag clearly functions as a serving bowl. In other preferred aspects of the present invention, the bag is folded about first and second, parallel, fold lines located on opposite sides of a periphery interconnection portion, then folded about a third fold line extending perpendicularly between the first and second fold lines at which time the popcorn kernels are introduced through the periphery interconnection portion which is then sealed, and then folded about a fourth fold line extending parallel to the third fold line, with the folded bag having a conventional, rectangular shape for secondary packaging.

The present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where.

Figure 1:
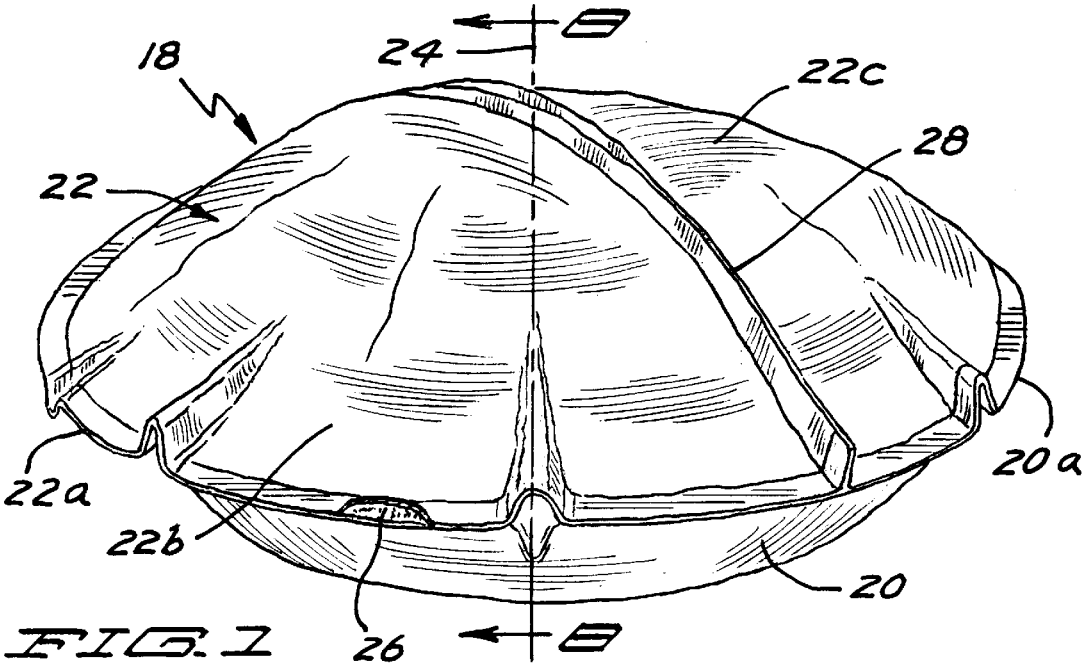
FIG. 1 shows a perspective view of a package fabricated in accordance with the preferred teachings of the present invention in generally an expanded condition.
Figure 2:
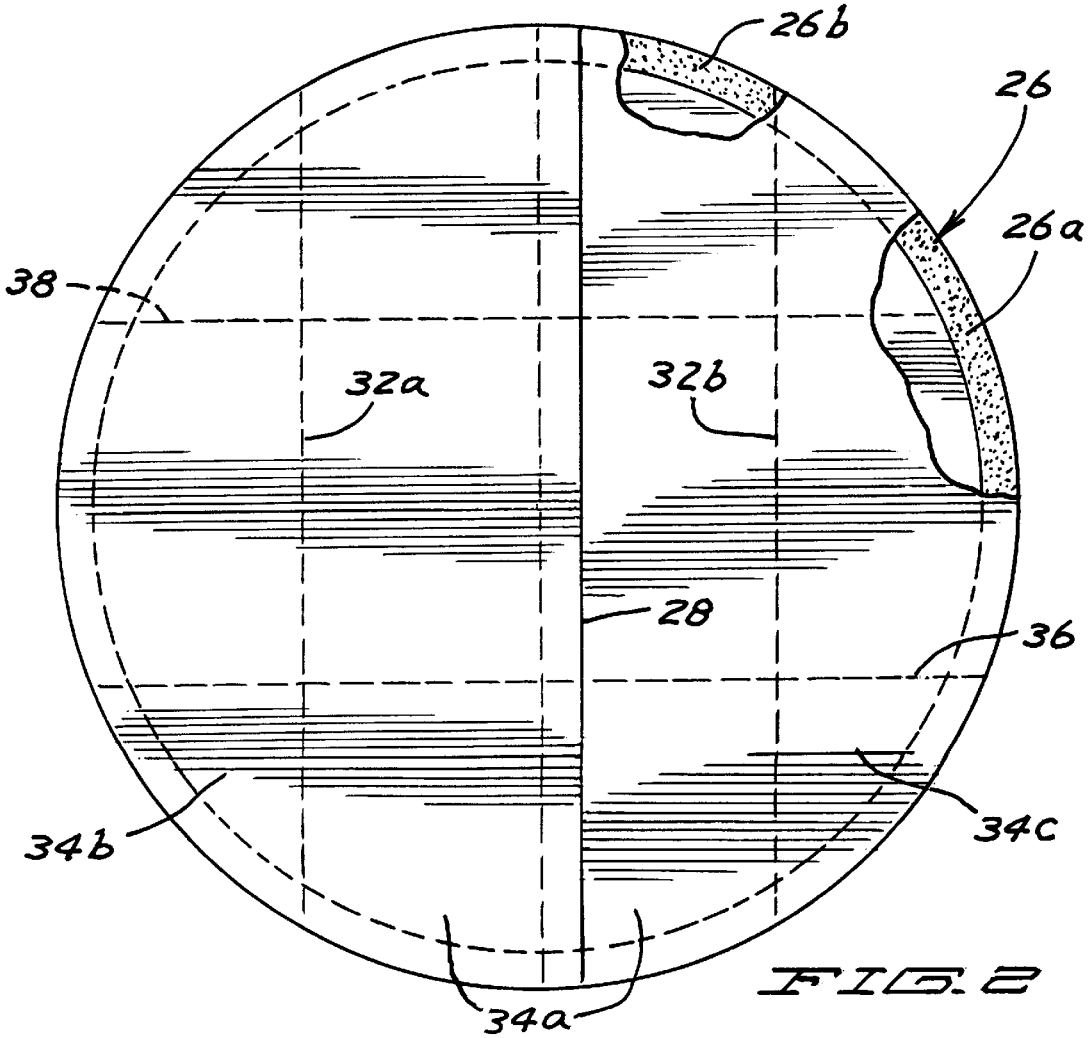
FIG. 2 shows a top plan view of the package of FIG. 1 in an unfilled, flat condition, with portions broken away.
Figure 3:
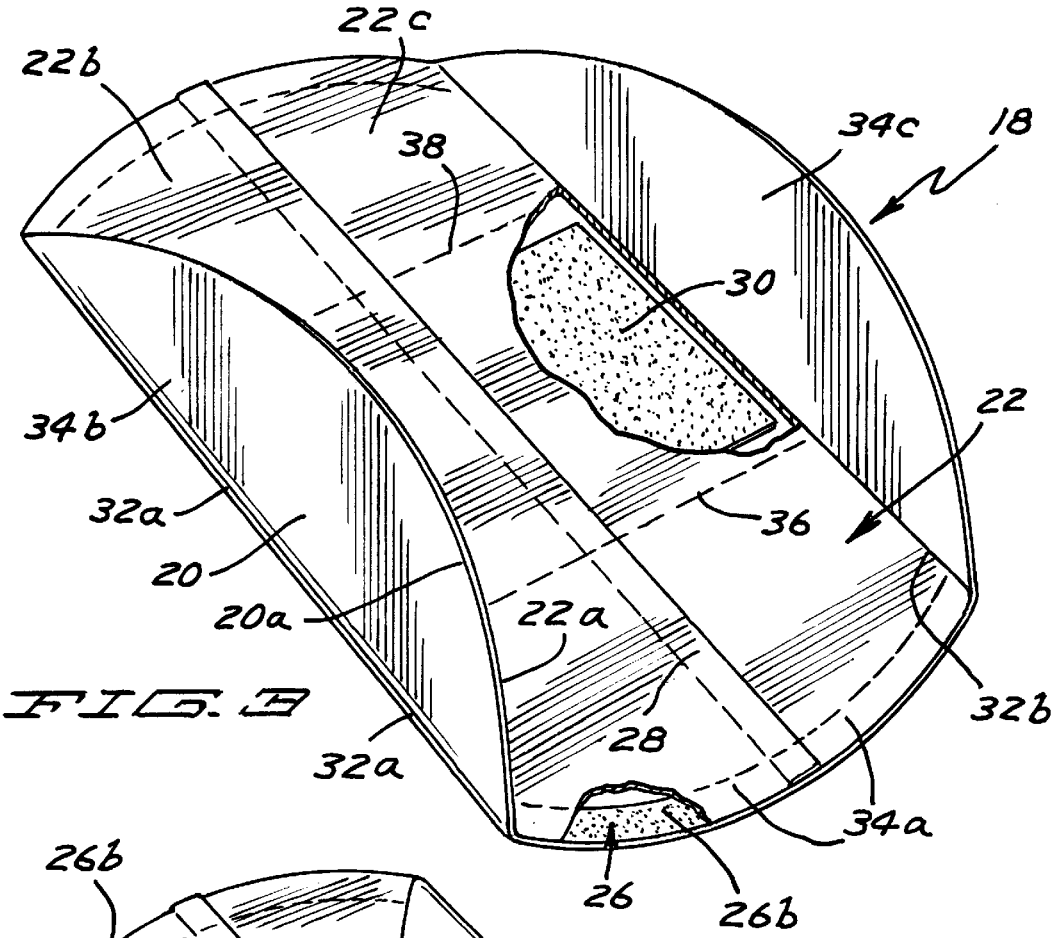
FIG. 3 shows a perspective view of the package of FIG. 1 in an unfilled, partially folded condition, with portions broken away.
Figure 4:
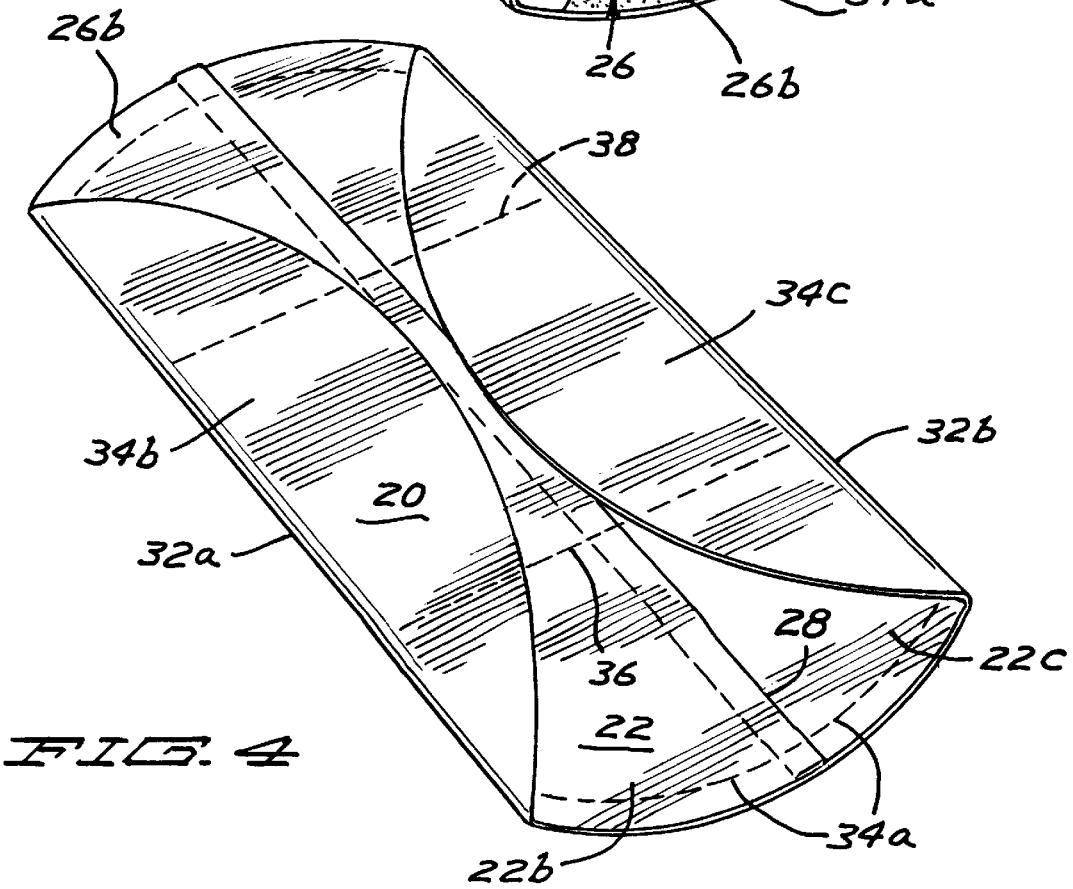
FIG. 4 shows a perspective view of the package of FIG. 1 in an unfilled, partially folded condition.
Figure 5:
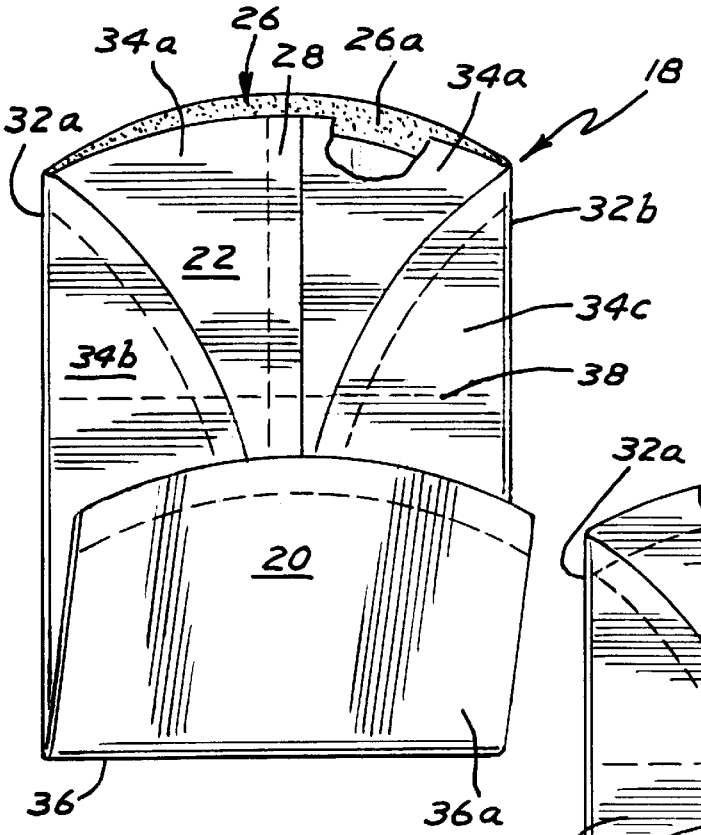
FIG. 5 shows a perspective view of the package of FIG. 1 in an unfilled, partially folded condition and with the peripheries in the upper edge separated for the introduction of popcorn kernels and the like, with portions broken away.
Figure 6:
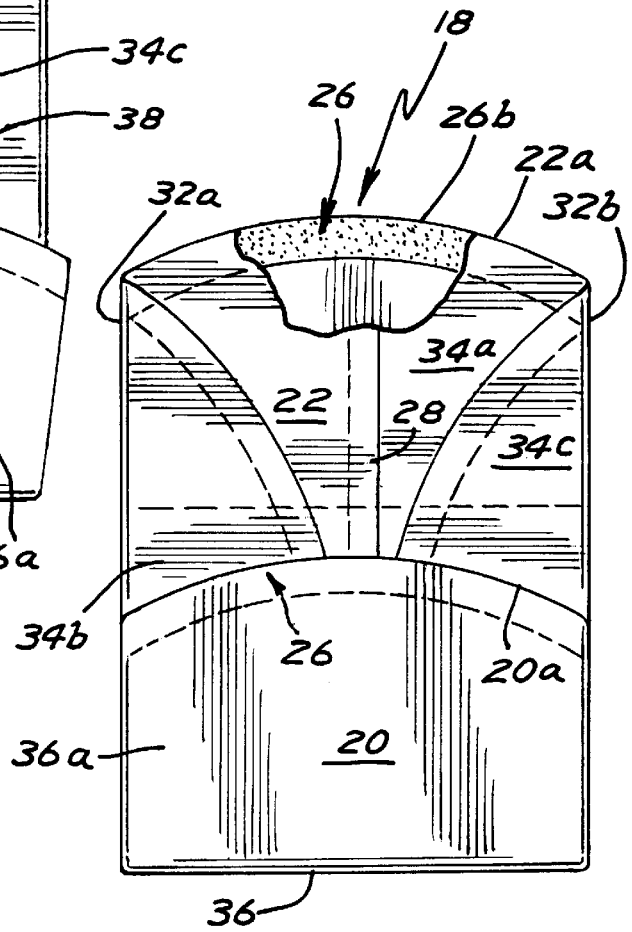
FIG. 6 shows a top plan view of the package of FIG. 1 in a filled, partially folded condition, with portions broken away.
Figure 7:
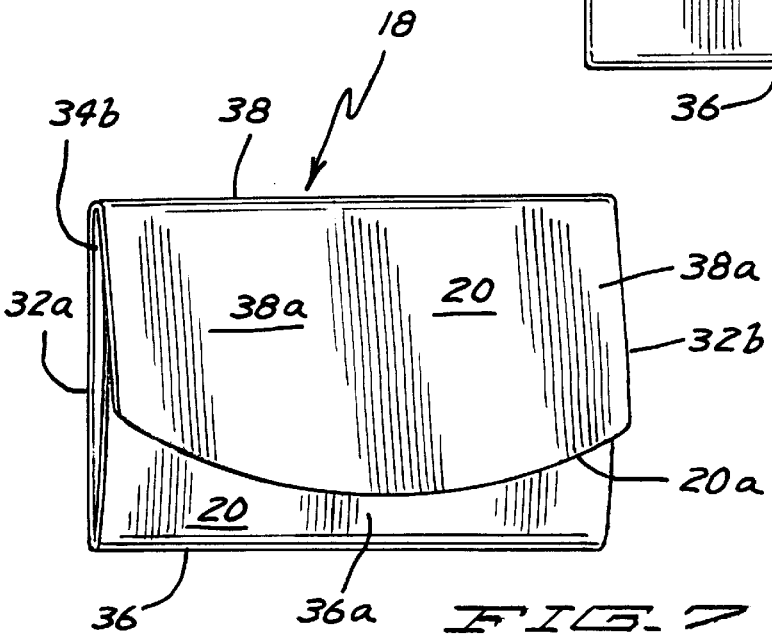
FIG. 7 shows a perspective view of the package of FIG. 1 in a filled, folded or collapsed condition.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "side", "end", "inner", "outer", "inside", "outside", and similar terms are used herein, it should be understood that these terms have reference only to the structure shown in the drawings as it would appear to a person viewing the drawings and are utilized only to facilitate describing the invention.

DESCRIPTION OF THE PREFERRED EMBODIMENT

A package for use in microwave ovens according to the preferred teachings of the present invention is shown as an expandable, flexible bag in the drawings and generally designated 18. It will facilitate the ensuing description to consider bag 18 in the horizontal position when placed in the microwave oven. Therefore, bag 18 includes a bottom wall 20 and a top wall 22 of a shape and size generally corresponding to bottom wall 20. Each wall 20 and 22 is formed by a sheet of flexible but non-extendable material such as paper including but not limited to base coated paper or similar cellose structures, such as polymers, or the like. The material forming walls 20 and 22 can be opaque, translucent, clear, or combinations thereof. Each wall 20 and 22 includes an outer periphery 20*a* and 22*a*, respectively, which is generally equidistant from the center 24 of the shape of walls 20 and 22 and in the most preferred form is generally circular in shape. However, peripheries 20*a* and 22*a* could be in other round-like shapes which are arcuate and/or include peripheral edge interconnections which do not have a tendency of getting hung up in the corners of the microwave oven such as symmetrical shapes including ovals, pentagons, hexagons, heptagons, octagons, etc. and such as non-symmetrical shapes such as generally egg shape.

To define a hollow interior, walls 20 and 22 are interconnected together adjacent to peripheries 20*a* and 22*a* by a seal which maintains the integrity of bag 18 during manufacture, handling, transportation and retailing of bag 18 and its contents and until microwave cooking. In the most preferred form, the interconnection between walls 20 and 22 is sufficient so as to seal adequately the vapor created within the bag 18 during the heating thereof in the microwave oven as well as to prevent undesired opening during the consumption of the popped kernels. In the most preferred form, a suitable annular adhesive strip 26 is added to the inside surface of one or both of walls 20 and 22 to secure walls 20 and 22 together adjacent peripheries 20*a* and 22*a* after the application of heat and/or pressure. Additionally, when interconnected by adhesive strip 26, walls 20 and 22 can be positioned so that they are generally planar and continuously abut without bulges or folds in the most preferred form. Although walls 20 and 22 are interconnected directly together adjacent to peripheries 20*a* and 22*a* in the most preferred form, walls 20 and 22 according to the teachings of the present invention could be interconnected together by their interconnection to a side wall which accordions during the expansion of bag 18 to increase the size of the hollow interior of bag 18 in its expanded condition.

In the most preferred form, bag 18 includes a susceptor patch 30 that extends over a portion of bottom wall 20 spaced from periphery 20*a* and in the most preferred form generally centered about center 24. Susceptor patch 30 can be formed in any suitable manner known in the art such as a metalized plastic film adhered to bottom wall 20 as diagrammatically shown in FIG. 8 (with the thickness of susceptor patch 30 being exaggerated for ease of illustration) or adhered between separate layers forming bottom wall 20, as a paper backed susceptor, or as a coating applied or printed to bottom wall 20. Further, although susceptor patch 30 is shown as overlying bottom wall 20 and thus located inside of bag 18, susceptor patch 30 can be located outside of bag 18 with bottom wall 20 overlying susceptor patch 30. Further, placement of susceptor patch 30 can occur at the material converter or on the manufacturing lines.

In the most preferred form, top wall 22 is formed from first and second wall portions 22*b* and 22*c* which are interconnected together by a fin seal 28. In the preferred form, portions 22*b* and 22*c* are generally semicircular in shape and fin seal 28 extends between opposite points on periphery 22*a* and specifically along a diameter of the circular shape of periphery 22*a*. Fin seal 28 provides a peelable closure which partially fails during microwave cooking. Specifically, this partial failure of fin seal 28 allows trapped steam to vent from bag 18 as well as allows the consumer to continue to peel seal 28 to open bag 18 after microwave cooking to provide access to the popped popcorn kernels in the hollow interior of bag 18 for consumption.

Bag 18 can be manufactured according to the preferred teachings of the present invention in the following manner. Specifically, walls 20 and 22 are positioned with their inside surfaces abutting together and with peripheries 20*a* and 22*a* aligned. A first, interconnection portion 26*a* of strip 26 is suitably activated to interconnect walls 20 and 22 together aside from a second, interconnection portion 26*b*. While first, interconnection portion 26*a* extends a substantial portion of peripheries 20*a* and 22*a*, second, interconnection portion 26*b* in the preferred form has a radial extent generally equal to one half of the diameter of the shape of peripheries 20*a* and 22*a*.

At that time, the partially formed bag 18 can be folded along parallel fold lines 32*a* and 32*b* which are radially spaced generally equal to one half of the diameter of the shape of peripheries 20*a* and 22*a* and extending from first and second points on opposite sides of and generally coextensive with the ends of portion 26*b*. In the preferred form, fold lines 32*a* and 32*b* are located on opposite sides of the diameter of the shape of peripheries 20*a* and 22*a* and equidistant therefrom. Thus, bag 18 is divided into a central portion 34*a* and first and second wings 34*b* and 34*c* which are folded to overlay central portion 34*a*. Wings 34*b* and 34*c* have a radial width generally equal to one fourth of the diameter of the shape of peripheries 20*a* and 22*a* and generally equal to one half of the radial width of central portion 34*a*. Thus, wings 34*b* and 34*c* do not overlay each other when folded to overlay central portion 34*a*. Bag 18 as folded at this point includes first and second, parallel, straight side edges defined by fold lines 32*a* and 32*b* and upper and lower edges which are generally convex defined by peripheries 20*a* and 22*a* intermediate fold lines 32*a* and 32*b*.

The partially formed bag 18 can then be folded about a third fold line 36 extending generally perpendicularly between the first and second straight side edges defined by fold lines 32*a* and 32*b* and located about one third of the diameter of the shape of peripheries 20*a* and 22*a* from the lower edge. Thus, bag 18 includes a wing 36*a* which includes the lower parts of portion 34*a* and wings 34*b* and 34*c* and which is folded to overlay wings 34*b* and 34*c*, with portion 26*b* being opposite to wing 36*a*. Bag 18 as folded at this point includes first and second, parallel, straight side edges defined by fold lines 32*a* and 32*b*, a straight lower edge defined by fold line 36 extending generally perpendicular to the side edges, and an upper edge which is generally convex defined by peripheries 20*a* and 22*a* intermediate fold lines 32*a* and 32*b* and including portion 26*b*.

While in a folded condition and held with walls 20 and 22 being vertical with the upper edge located vertically above the lower edge, peripheries 20*a* and 22*a* in the upper edge are separated and a charge of popcorn kernels, fat or oil, salt, flavorings, or the like are introduced into the interior of bag 18. It should be appreciated that due to the folded condition of bag 18, the charge is generally prevented from passing beyond fold lines 32*a*, 32*b* and 36 and into wings 34*b*, 34*c*, and 36*a* but is retained adjacent center 24 of bag 18.

After the charge has been introduced, portion 26*b* can be suitably activated to interconnect walls 20 and 22 together. Thus, walls 20 and 22 are interconnected together around the entire length of peripheries 20*a* and 22*a*. Additionally, strip 26 and seal 28 close bag 18 so that the charge in the hollow interior of bag 18 is completely sealed from the environment.

After portion 26*b* is sealed, bag 18 can again be folded about a fourth fold line 38 extending generally perpendicularly between the first and second straight side edges defined by fold lines 32*a* and 32*b* and parallel to fold line 36 and located about one third of the diameter of the shape of peripheries 20*a* and 22*a* from the upper edge. Fold line 38 is located adjacent to peripheries 20*a* and 22*a* of wing 36*a* and is located above the charge in the hollow interior of bag 18. Thus, bag 18 includes a wing 38*a* which includes the upper parts of portion 34*a* and wings 34*b* and 34*c* and which is folded to overlay wing 36*a*. It should be appreciated that due to the folded condition of bag 18, the charge is also generally prevented from passing beyond fold line 38 and into wing 38*a* but is retained adjacent center 24 of bag 18. Bag 18 as folded at this point is generally rectangular shaped of a size and shape of conventional folded, paper popcorn bags and includes first and second parallel side edges defined by fold lines 32*a* and 32*b*, and parallel lower and upper edges defined by fold lines 36 and 38, respectively. In the most preferred form, the folded, charged bag 18 is sealed into a flexible overwrap for packaging and storage. Conventionally, such overwrap is formed by clear or opaque translucent plastic but could be formed by metalized film, sputtered glass/ceramic or other barrier constructions. It of course should be appreciated that typically such overwrap is removed by the consumer just prior to microwave cooking.

Figure 8:
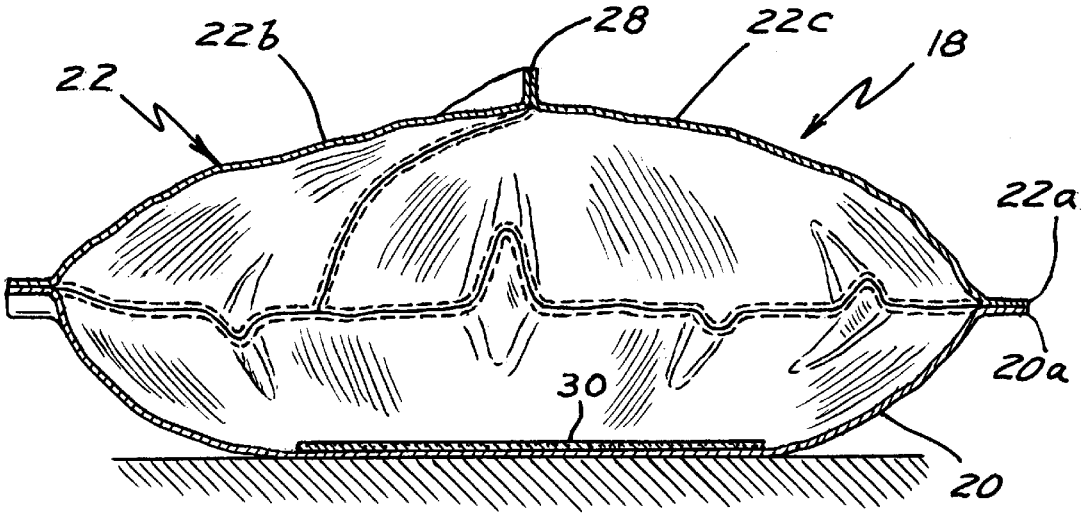
FIG. 8 shows a cross sectional view of the package of FIG. 1 according to section line 8—8 of FIG. 1, with the popped popcorn being removed for ease of illustration.
Figure 9:
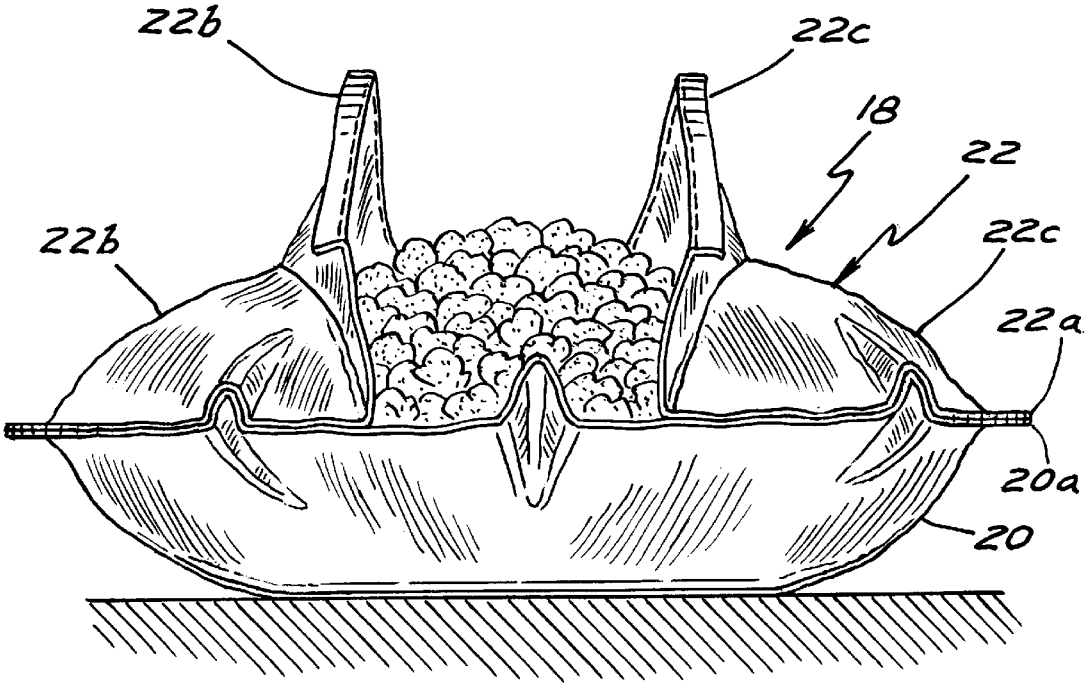
FIG. 9 shows a side view of the package of FIG. 1 in an opened condition.

For the sake of completeness, it will be assumed that the contents or charge of bag 18 are popcorn kernels or any suitable grain such as rice, maze, barley, sorghum, or the like for being popped or puffed when in the microwave oven. Particularly, as with current bags, bag 18 is placed in a microwave oven with bottom wall 20 resting upon the bottom surface of the oven cavity and preferably with bag 18 being partially or completely unfolded by the consumer. When subjected to microwave energy, susceptor patch 30 converts microwave energy into heat, with the heat and remaining microwave energy causing the popping of the kernels and the generation of water vapor/steam. The water vapor and heated vapor pressure air cause wings 38*a*, 36*a*, 34*b* and 34*c* to unfold or to continue to unfold about fold lines 38, 36, 32*a* and 32*b*, respectively, so that walls 20 and 22 have a continuous shape. Each wall 20 and 22 expand into a bowl, hemispheric or parabolic curve shape from their peripheries 20*a* and 22*a* with the inside surfaces of bottom and top walls 20 and 22 being spaced, expanding bag 18 and increasing the interior volume inside of bag 18 for the popped kernels. It can then be appreciated that due to its flexible nature, bag 18 will expand to an opposing, double dome shape. However, due to the non-extendable nature of the material forming walls 20 and 22, the interconnection between walls 20 and 22 adjacent to peripheries 20*a* and 22*a* will tend to gather and pucker as best seen in FIGS. 1, 8, and 9 as walls 20 and 22 change their shape from being generally planar to being dome shaped. When bag 18 is formed of paper conventionally utilized for popcorn packages without further processing, the size, shape and direction of such puckers will generally not be uniform around peripheries 20*a* and 22*a* and will tend to vary between different bags 18.

Bag 18 according to the preferred teachings of the present invention is advantageous over prior bags. Particularly, only a single layer of material forming walls 20 and 22 extends over the charge of popcorn kernels generally from the start of microwave cooking. Thus, it is not necessary for the initial microwave energy to penetrate several layers of material before reaching the charge and therefore the microwave energy is generally available quicker and in greater amounts to the charge.

Further, the bowl or parabolic curve shape of the inflated bag 18 keeps the unpopped kernels huddled closer together even in more than a single layer at the bottom of the shaped wall 20 and in closer contact with susceptor patch 30 in the preferred form. This close nesting or clustering of the unpopped kernels is a very efficient and attractive load for incoming microwaves. Specifically, the cluster load radiates less heat, and temperature increases at a quicker rate. The cluster load has a higher loss tangent (more lossy) than a dispersed load.

Further, as the bowl or parabolic curve shape has a relatively low surface area to volume relationship similar to that of a sphere, walls 20 and 22 include less material which competes for microwave energy with the kernels.

Additionally, when the kernels pop, the popping kernels may spray unpopped kernels from the nesting. However, bag 18 according to the teachings of the present invention allows the unpopped kernels to settle to the bottom of the shaped wall 20 much like a covered Japanese Wok pan does. Further, the expansion of bag 18 according to the teachings of the present invention generally does not create folds or crevices which capture unpopped kernels and prevent their movement towards the cluster of any other unpopped kernels and/or susceptor patch 30.

Furthermore, the force of the popping kernels hitting against walls 20 and 22 jostles or vibrates bag 18 which enables the unpopped kernels to fall through the popped kernels and reengage wall 20 and to slide on wall 20 to the bottom thereof. Specifically, the vibration of bag 18 creates agitation of the popped and unpopped kernels in bag 18 resulting in gravimetric separation of the unpopped kernels to the bottom of the popped kernels due to their greater density. In this regard, the bowl or parabolic curve shape of bottom wall 20 enhances the ability of bag 18 to rock in any direction from the force of the popping kernels hitting against walls 20 and 22 to maximize the gravimetric separation of the unpopped kernels to the bottom of the popped kernels.

Still further, the bowl or parabolic curve shape of inflated bag 18 greatly improves popping performance in the diverse microwave ovens available to consumers. As much as a 40% improvement in popping performance was experienced with bag 18 according to the preferred teachings of the present invention compared to paper popcorn bags of conventional shapes under variations experienced in normal use. These variations include but are not limited to microwave ovens of differing wattage, volume, and/or efficiency, fluctuations in electric current, different magnetrons of the same or different manufacture, different wave guides, and the like.

If susceptor patch 30 is provided as in the preferred form, there is no need to include susceptor patch 30 at locations where unpopped kernels are not. Thus, susceptor patch 30 is located only at the bottom of the shaped wall 20 and can be of a minimized size due to the bowl or parabolic curve shape of wall 20. In this regard, and especially due to the bowl or parabolic curve shape of wall 20, susceptor patch 30 may be shaped to minimize material utilized such as being circular in shape or being in non-continuous areas. In the most preferred form, patch 30 is located within fold lines 32*a*, 32*b*, 36, and 38.

Also, the round-like shapes of peripheries 20*a* and 22*a* of walls 20 and 22 and thus of bag 18 distribute the popped kernels into a wider distribution field. Being spread in the microwave oven cavity, the popped kernels become less attractive and are fairly transparent to the microwave energy. In addition to the less dense load configuration, the popped kernels are able to dissipate the heat better and therefore not allowing the popped kernels to continue to overcook, carmelize, burn, char, or dry out any further. This results in bag 18 that is less prone to scorching the popped product.

Further, the round-like shapes of peripheries 20*a* and 22*a* of walls 20 and 22 and thus of bag 18 work very well in all microwave ovens equipped with or without turntables. No matter where the consumer places bag 18 in the microwave oven, bag 18 will always inflate and position itself near the center of the microwave oven. The round-like profile does not allow bag 18 to get hung up in the corners of the microwave ovens where typically cooler spots exist. The round-like shape always continues to rotate on the turntable ovens. This centered and/or rotating positioning of bag 18 allows bag 18 to move so that it is less likely for any particular point in bag 18 to see specific hot spots or electronic nulls and allows the opportunity for the most consistent and uniform distribution of microwave cooking.

It should be noted that fin seal 28 of the most preferred form partially releases to vent steam from bag 18 during microwave cooking. Additionally, after removal from the microwave oven, the consumer can grasp portions 22*b* and 22*c* on opposite sides of seal 28 and pull them apart to further release fin seal 28 and if desired the interconnection between peripheries 20*a* and 22*a* adjacent to fin seal 28 in a manner as shown in FIG. 9 to allow access to the hollow interior of bag 18 and specifically to the popped popcorn located therein. It can then be appreciated that bag 18 having top wall 22 including the peelable closure clearly functions as a serving bowl.

It should be appreciated that although the serving bowl function is accomplished by the peelable closure formed by fin seal 28 in the most preferred form, the serving bowl function can be formed by other manners including by using perforations, tear strips, cut scoring, thinning sealant, controlled delamination, and multipaper fabrications according to the teachings of the present invention. Likewise, although providing the peelable closure in top wall 22 is believed to be advantageous at least because of the serving bowl function, the peelable closure which fails during microwave cooking to provide venting can be formed at other locations such as in portion 26*b* which would allow the popped popcorn to be poured therethrough.

Additionally, although the particular manner of manufacture, filling, and folding of bag 18 is believed to be advantageous including but limited to having a final conventional, rectangular shape for secondary packaging purposes, bag 18 can be manufactured, filled and/or folded in other manners according to the teachings of the present invention. In this regard, it may be desirable to fold or otherwise configure bag 18 to have a final shape which is different than other conventional shapes to emphasize the uniqueness of bag 18 in the marketing thereof.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

I claim:

1. Expandable microwave package for holding a grain for popping or puffing in a microwave oven comprising, in combination: a bag including a bottom wall and a top wall, with the bottom and top walls each formed of a sheet of non-extendable flexible material, with the bottom wall having an outer periphery of a substantially round shape, with the top wall having an outer periphery of a substantially round shape and size corresponding to the outer periphery of the bottom wall, with the bottom and top walls being interconnected together adjacent to the outer peripheries, with the top and bottom walls expanding into an opposing double domed shape when the grain is popped or puffed in the microwave oven, with the interconnected outer peripheries puckering as the top and bottom walls expand into the opposing double domed shape.

2. The expandable microwave package of claim 1 wherein the outer peripheries are circular in shape.

3. The expandable microwave package of claim 1 wherein the bag further includes a peelable closure which fails during microwave cooking allowing trapped steam to vent and allowing the bag to be opened to provide access to the popped or unpuffed grain.

4. The expandable microwave package of claim 3 wherein the peelable closure is formed in the top wall.

5. The expandable microwave package of claim 4 wherein the top wall includes first and second wall portions and a seal between the first and second wall portions, with the seal between the first and second wall portions forming the peelable closure.

6. The expandable microwave package of claim 5 wherein the seal extends between two points on the outer periphery of the top wall.

7. The expandable microwave package of claim 6 wherein the seal extends along a diameter of the shape of the outer periphery of the top wall.

8. The expandable microwave package of claim 1 wherein the bottom and top walls are directly interconnected together adjacent to the outer peripheries.

9. The expandable microwave package of claim 1 wherein the bottom and top walls are interconnected together adjacent to the outer peripheries by a first interconnection portion and a second interconnection portion, with the first interconnection portion extending a substantial portion of the outer peripheries, with the first interconnection portion interconnecting the outer peripheries prior to and after the introduction of the grain into the bag, with the second interconnection portion allowing separation of the outer peripheries in the second interconnection portion for the introduction of the grain in the bag and interconnecting the outer peripheries in the second interconnection portion after the introduction of the grain into the bag.

10. The expandable microwave package of claim 9 wherein the first and second interconnection portions interconnect the outer peripheries in a sealing manner which does not vent during microwave cooking.

11. The expandable microwave package of claim 9 wherein the bag further includes first and second fold lines extending from first and second points on opposite sides of the second interconnection portion, with the first and second fold lines dividing the bag into a central portion and first and second wings, with the first and second wings overlaying the central portion.

12. The expandable microwave package of claim 11 wherein the first and second fold lines are in a spaced parallel relation.

13. The expandable microwave package of claim 12 wherein the radial distance between the first and second fold lines is generally equal to one half of a diameter of the shapes of the outer peripheries, with the first and second fold lines located on opposite sides of the diameter of the shapes of the outer peripheries and equidistant therefrom.

14. The expandable microwave package of claim 12 wherein the bag further includes a third fold line extending between the first and second fold lines when the first and second wings overlay the central portion, with the third fold line defining a third wing overlaying the first and second wings.

15. The expandable microwave package of claim 14 wherein the third fold line extends generally perpendicular between the first and second fold lines, with the radial distance between the outer peripheries and the third fold line is generally equal to one third of the diameter of the shapes of the outer peripheries, with the second interconnection portion being opposite to the third wing.

16. The expandable microwave package of claim 15 wherein the bag includes a fourth fold line extending between the first and second fold lines when the first and second wings overlay the central portion, with the fourth fold line defining a fourth wing overlaying the third wing.

17. The expandable microwave package of claim 16 wherein the fourth fold line extends generally parallel to the third fold line, with the radial distance between the outer peripheries and the fourth line being generally equal to one third of the diameter of the shapes of the outer peripheries.

18. The expandable microwave package of claim 16 further comprising, in combination: a susceptor patch extending over the bottom wall and generally between the first, second, third, and fourth fold lines.

19. The expandable microwave package of claim 1 wherein the sheets of flexible material are paper.

20. The expandable microwave package of claim 1 wherein the package holds grain in the form of popcorn kernels.

21. The expandable microwave package of claim 1 wherein the domed shape of the bottom wall is of a parabolic curve shape to keep the unpopped or unpuffed grain huddled closer together.

22. The expandable microwave package of claim 1 wherein the domed shape of the bottom wall is of a parabolic curve shape to enhance the ability of the bag to rock in any direction from the force of the popping or puffing grain hitting against the bag to maximize gravimetric separation of the unpopped or unpuffed grain to the bottom of the popped or puffed grain.

* * * * *